US006663758B2

(12) United States Patent
Motohashi et al.

(10) Patent No.: US 6,663,758 B2
(45) Date of Patent: Dec. 16, 2003

(54) METHOD AND APPARATUS FOR PRODUCING ELECTROLYTIC COPPER FOIL

(75) Inventors: Shigetada Motohashi, Shimodate (JP); Masashi Amakata, Shimodate (JP)

(73) Assignee: Nippon Denkai, Ltd., Tokyo (JP)

( * ) Notice: Subject to any disclaimer, the term of this patent is extended or adjusted under 35 U.S.C. 154(b) by 284 days.

(21) Appl. No.: 09/849,221

(22) Filed: May 7, 2001

(65) Prior Publication Data

US 2002/0005363 A1 Jan. 17, 2002

(30) Foreign Application Priority Data

May 31, 2000 (JP) ..... 2000-162427

(51) Int. Cl.[7] ..... C25D 1/04; C25D 17/00; C25D 21/12; C25C 1/12

(52) U.S. Cl. ..... 205/77; 205/574; 204/212; 204/230.7; 204/275.1

(58) Field of Search ..... 205/77, 132, 134, 205/152, 574; 204/212, 230.7, 275.1

(56) References Cited

U.S. PATENT DOCUMENTS 4,490,218 A * 12/1984 Kadija et al. ..... 205/77
6,183,607 B1 * 2/2001 Clouser et al. ..... 204/199
6,291,080 B1 * 9/2001 Yates et al. ..... 205/77 X
6,361,673 B1 * 3/2002 Ameen et al. ..... 205/77

* cited by examiner

*Primary Examiner*—Donald R. Valentine
(74) *Attorney, Agent, or Firm*—Antonelli, Terry, Stout & Kraus, LLP

(57) ABSTRACT

An electrolytic copper foil is electrodeposited onto the cathodic drum surface of a rotating cathode drum by feeding an electrolytic solution between the cathode drum and an anode facing each other and applying direct current between them, while the initial formation of the crystal nuclei of the electrolytic copper foil is performed by providing an auxiliary anode, an electrolytic solution receiver and a flashboard above the anode and applying an electric current between the cathode drum and the auxiliary anode and feeding an electrolytic solution separately onto the cathodic drum surface from an electrolytic solution feeder placed near the auxiliary anode and discharging it through the gap between the cathodic drum surface and the edge of the electrolytic solution receiver, keeping an electrolytic solution holdup between the cathodic drum surface and the auxiliary anode by the electrolytic solution receiver and the flashboard.

17 Claims, 2 Drawing Sheets

(BACKGROUND)

METHOD AND APPARATUS FOR PRODUCING ELECTROLYTIC COPPER FOIL

BACKGROUND OF THE INVENTION (a) Field of the Invention

The present invention relates to a method for producing electrolytic copper foil and an apparatus used for the method, particularly to a method and an apparatus for producing electrolytic copper foil, which is fairly free from internal defects due to uneven formation of crystal nuclei at the beginning of electrodeposition, such as pinholes and curl.

(b) Description of the Related Art

Electrolytic copper foil is commonly produced, as shown in FIG. 1, by mounting in electrolysis tank 1 rotating cylindrical cathode drum 2 and arcuate anode 3 facing each other leaving gap 4, by electrodepositing electrolytic copper foil 6 on the surface of cathode drum 2 by feeding electrolytic solution 5 into gap 4 and applying direct current to electrodeposit electrolytic copper foil 6 on the surface of cathode drum 2, and continuously winding electrolytic copper foil 6.

In the production of electrolytic copper foil, it has been tried to produce pinhole-free copper foil by forming many crystal nuclei densely at the beginning of electrodeposition by using an anode provided apart from the arcuate anode. In the method disclosed in Japanese Patent Application Unexamined Publication No. 9-157883 (1997), a high current anode is provided apart from the anode for electrolysis so that it partially juts out from the overflowing electrolytic solution and faces the surface of the rotating cathode drum where electrodeposition begins, and a current of high current density is applied to the electrolytic solution between the rotating cathode drum and the high current anode, to form many crystal nuclei densely. This method, however, cannot make electrolytic copper foil sufficiently free from pinholes and curl, because the large amount of gas generated by the electrolysis undergoing at the ordinary electrolysis area forms large bubbles as the fluid pressure decreases near the liquid surface, to inhibit uniform supply of the electrolytic solution (copper ions) and uniform formation of the crystal nuclei.

Japanese Patent Application Unexamined Publication No. 10-18076 (1998) discloses preventing the pinhole defects in foil due to the unevenness at the beginning of electrodeposition by providing an auxiliary anode capable of increasing at the beginning of electrodeposition the average current density for the production of foil by more than 60%. The method, due to the large amount of gas generated by the electrolysis undergoing at the ordinary electrodeposition area, also cannot reduce curl and pinholes in electrolytic copper foil sufficiently.

Copper foil used in printed wiring boards or the like has become thinner, causing strict requirements for the prevention of curl and pinholes and demanding techniques of producing electrolytic copper foil freed sufficiently from curl and pinholes.

SUMMARY OF THE INVENTION

An object of the present invention is to provide a method of producing electrolytic copper foil whereby the initial formation of the crystal nuclei of electrolytic copper foil can be performed by applying a current of high current density to an auxiliary anode at the beginning of electrodeposition without being affected by the gas generated during the electrolysis at the ordinary electrodeposition area, and the formation of curl and pinholes can be prevented sufficiently. Another object of the present invention is to provide an apparatus to be used for the method.

As the result of study to prevent at the time of the initial formation of crystal nuclei with an auxiliary anode the formation of curl and pinholes due to the gas generated by the electrolysis at the ordinary electrodeposition area, we have found the formation of curl and pinholes in the electrolytic copper foil can be prevented by feeding the electrolytic solution for the initial electrodeposition and the electrolytic solution for the ordinary electrodeposition separately. Based on the finding, we have completed the present invention.

Accordingly, the present invention provides a method of producing electrolytic copper foil, comprising applying a direct current between a rotating cathode drum having a cathodic drum surface and an anode, which has an arcuate section and faces the cathodic drum surface to define a gap between them, while an electrolytic solution is being fed to the gap to electrodeposit electrolytic copper foil on the cathodic drum surface; and applying a direct current between the rotating cathode drum and an auxiliary anode, which is mounted together with an electrolytic solution receiver and a flashboard above the anode having an arcuate section, while an electrolytic solution is being fed onto the cathodic drum surface from an electrolytic solution feeder provided near the auxiliary anode and is being discharged through a gap between the cathodic drum surface and an edge of the electrolytic solution receiver while keeping an electrolytic solution holdup between the cathodic drum surface and the auxiliary anode by the electrolytic solution receiver and the flashboard.

The present invention further provides an apparatus for producing an electrolytic copper foil by applying a direct current between a rotating rotary cathode drum having a cathodic drum surface and an anode, which has an arcuate section and faces the cathode drum to define a gap between them, while an electrolytic solution is being fed to the gap to electrodeposit electrolytic copper foil on the cathodic drum surface, comprising the rotary cathode drum having the cathodic drum surface;

the anode, which has an arcuate section and faces the cathodic drum surface to define a gap therebetween;

a means of feeding the electrolytic solution to the gap between the cathodic drum surface and the anode;

an auxiliary anode facing the cathodic drum surface above the anode having an arcuate section;

an electrolytic solution feeder for feeding an electrolytic solution between the cathodic drum surface and the auxiliary anode; and an electrolytic solution receiver and a flashboard which are placed above the anode having an arcuate section so as to keep an electrolytic solution holdup between the cathodic drum surface and the auxiliary anode;

a gap being left between the upper end of the anode having an arcuate section and an underside of the electrolytic solution receiver, and a gap being left between the cathodic drum surface and an edge of the electrolytic solution receiver.

DESCRIPTION OF THE PREFERRED EMBODIMENTS

Figure 2:
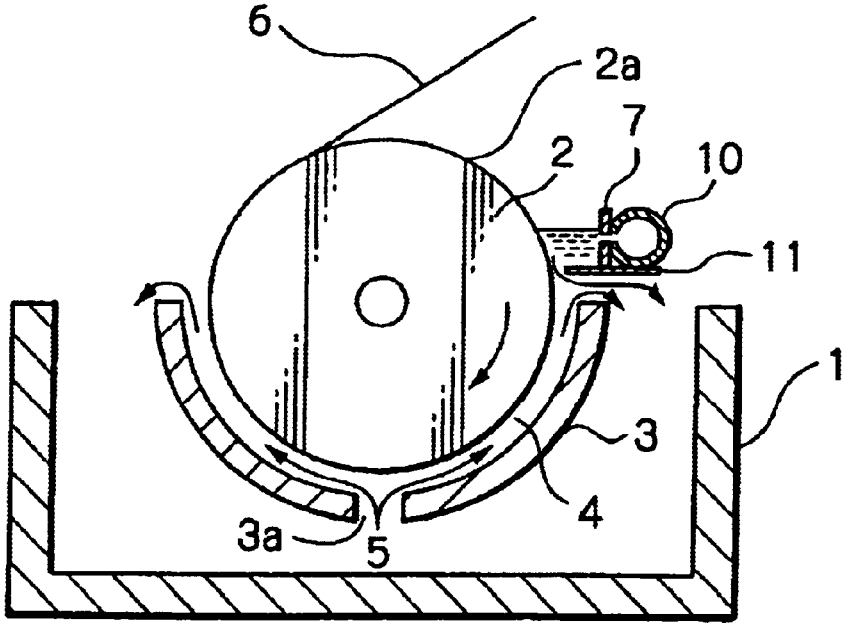
FIG. 2 is a sectional view illustrating an apparatus for producing electrolytic copper foil of an embodiment according to the present invention.
Figure 3:
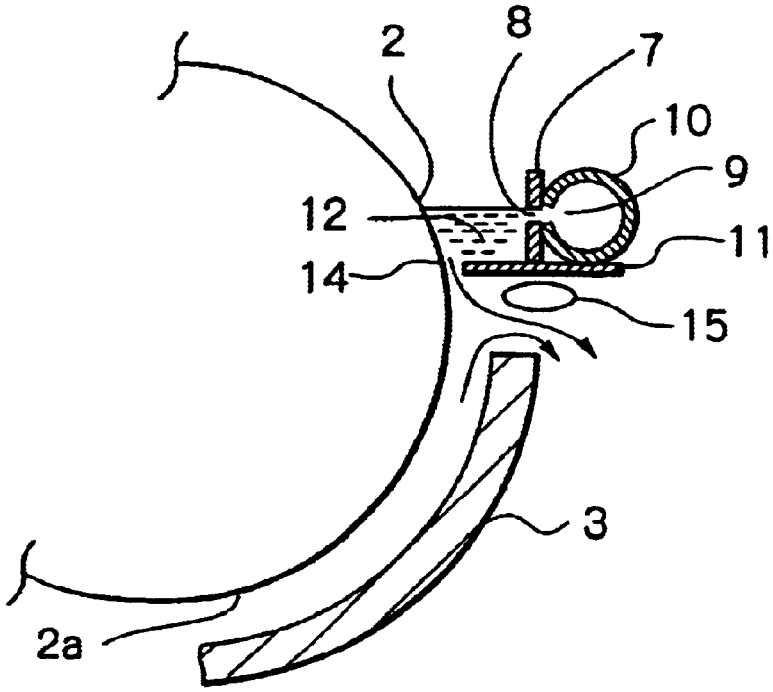
FIG. 3 is a partially enlarged sectional view of the apparatus of FIG. 2, showing a part including an auxiliary anode.
Figure 4:
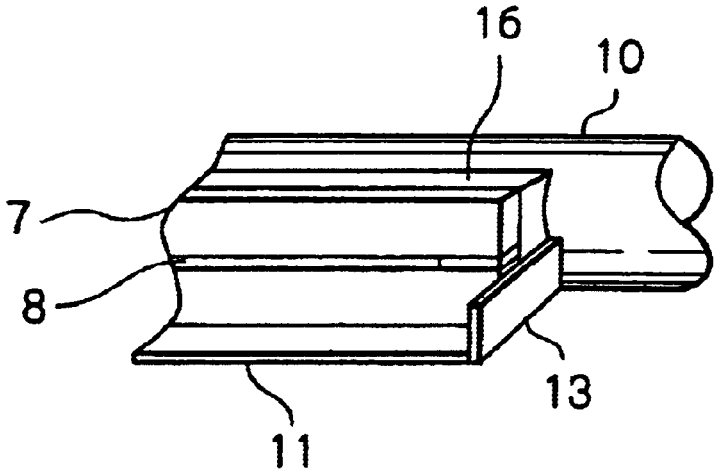
FIG. 4 is a partially sectional, perspective view of the auxiliary anode of an apparatus for producing electrolytic copper foil of another embodiment according to the present invention.

FIG. 2 shows a sectional view illustrating an apparatus for producing electrolytic copper foil 6 of an embodiment according to the present invention. As shown in FIG. 2, the apparatus for producing electrolytic copper foil according to the present invention has auxiliary anode 7 for the initial formation of crystal nuclei of electrolytic copper foil above anode 3 having an arcuate section. Near auxiliary anode 7 is mounted electrolytic solution feeding pipe 10 as an electrolytic solution feeder, which feeds an electrolytic solution onto cathodic drum surface 2*a* of rotary cathode drum 2. Cathode drum 2 is mounted in electrolysis tank 1 with its axis adjusted horizontal, and anode 3 faces cathodic drum surface 2*a* below cathode drum 2 to define gap 4. Anode 3 has electrolytic solution inlet 3*a* of anode 3 for feeding electrolytic solution 5 into gap 4 between cathodic drum surface 2*a* and anode 3. By a means for feeding an electrolytic solution, such as a pump (not shown), electrolytic solution 5 is fed from the inside or outside of electrolysis tank 1 through electrolytic solution inlet 3*a* into gap 4, and flown through gap 4 and finally over both upper ends of anode 3. Auxiliary anode 7 is placed above an upper end of anode 3 and above electrolytic solution 5 flowing over the upper end of the anode 3. The upper end of anode 3 located below auxiliary anode 7 faces a region of cathodic drum surface 2*a* where the electrodeposition of electrolytic copper foil by the application of electric current between cathode drum 2 and anode 3 begins. Electrolytic solution receiver 11 extending toward cathodic drum surface 2*a* is mounted above the overflowing electrolytic solution 5 and under auxiliary anode 7. FIG. 3 is a partially enlarged sectional view of the apparatus of FIG. 2, showing a part including the auxiliary anode. Flat-plate auxiliary anode 7 has a slit 8 at the middle. Electrolytic solution feeding pipe 10 mounted behind auxiliary anode 7 has slit 9, which has a form corresponding to slit 8 of auxiliary anode 7 and is aligned with slit 8. An electrolytic solution is sprayed from slit 9 of electrolytic solution feeding pipe 10 through slit 8 made in flat-plate auxiliary anode 7 at the middle and finally on cathodic drum surface 2*a* of cathode drum 2. Electrolytic solution receiver 11 and flashboards (not shown) attached to both sides of electrolytic solution receiver 11 keep electrolytic solution holdup 12 between auxiliary anode 7 and cathodic drum surface 2*a*. FIG. 4 shows a partially sectional, perspective view of the auxiliary anode of an apparatus for producing electrolytic copper foil of another embodiment according to the present invention. Frame 16 covers the area where slit 9 (not shown in FIG. 4) of electrolytic solution feeding pipe 10 is aligned with slit 8 of auxiliary anode 7 to prevent the leakage of the electrolytic solution. The depth of electrolytic solution holdup 12 can be controlled by flashboards 13 attached to both sides of electrolytic solution receiver 11.

In the embodiments as shown in FIGS. 2, 3 and 4, an electrolytic solution is fed from slit 9 (not shown in FIGS. 2 and 4) of electrolytic solution feeding pipe 10 through slit 8 made in the middle of auxiliary anode 7, but may be fed from any other electrolytic solution feeder, such as a perforated-pipe provided near the auxiliary anode. The perforated-pipe preferably has pores aligned with the slit of the auxiliary anode. The auxiliary anode does not always need a slit, but using an auxiliary anode having a slit enables to balance the flow rate of the electrolytic solution fed to the cathodic drum surface and the level of the electrolytic solution by adjusting the width of the slit.

The electrode gap between the electrode surface of auxiliary anode 7 and cathodic drum surface 2*a* is preferably 5 to 20 mm, more preferably 7 to 15 mm. The depth of electrolytic solution holdup 12 is preferably 5 to 25 mm, more preferably 10 to 20 mm. The gap 14 between the edge of electrolytic solution receiver 11 and cathodic drum surface 2*a* is preferably 1 to 5 mm, more preferably 1 to 3 mm. Vacant space 15 is formed between the upper end of anode 3 and the underside of electrolytic solution receiver 11, and the gap between the upper end of anode 3 and the underside of electrolytic solution receiver 11 is preferably 15 to 30 mm, more preferably 15 to 25 mm.

An acidic copper sulfate solution is preferably used as the electrolytic solution used in the method of producing electrolytic copper foil according to the present invention. The preferred ranges of the composition of the electrolytic solution and electrolysis conditions are as follows.

Composition of electrolytic solution

Copper sulfate pentahydrate: 100–400 g/l

Sulfuric acid: 20–200 g/l

Additives (optional): chloride ion source 0–100 mg/l, gelatin 0–100 mg/l

Electrolysis conditions

Temperature of electrolytic solution: 30–60° C.

Current density of arcuate anode: 20–200 A/dm$^2$

Current density of auxiliary anode: 30–300 A/dm$^2$

Material of anode: titanium (base material) coated with a platinum metal oxide

Material of cathode: titanium or titanium alloy

The current density of auxiliary anode 7 is preferably higher than the current density of anode 3. Increasing the current density of auxiliary anode 7 increases the number and density of crystal nuclei formed, and the current density of auxiliary anode 7 is preferably 1.5 to 10 times that of anode 3. The feeding rate of the electrolytic solution from electrolytic solution feeding pipe 10 is generally 20 l/min or more, preferably 30 to 100 l/min.

As shown in FIGS. 2 and 3, electrolytic solution 5 used for the electrolysis between cathode drum 2 and anode 3 (may be called hereinafter ordinary electrolysis) is flown over the upper ends of anode 3 into electrolysis tank 1 or to an outlet (not shown). On the other hand, as shown in FIGS. 2 and 3, the electrolytic solution used for the initial formation of the crystal nuclei of electrolytic copper foil is fed through a route separate from that for electrolytic solution 5 to be used for ordinary electrolysis, and discharged through gap 14 between cathodic drum surface 2*a* and the edge of electrolytic solution receiver 11. A vacant space 15 is formed over the two flows of the electrolytic solution, and the large amount of gas generated by the ordinary electrolysis is discharged through vacant space 15 between the underside of electrolytic solution receiver 11 and the upper end of anode 3 without affecting the electrolytic solution for the initial formation of crystal nuclei. Therefore, by using the method and apparatus of the present invention, uniform electrolytic copper foil sufficiently free from pinholes and curl can be produced without being affected by the gas generated by the ordinary electrolysis. Conventional methods and apparatuses, wherein an electrolytic solution is fed both for the ordinary electrolysis and the initial formation of crystal nuclei through the same flow, cannot evade the effects of the gas generated by the ordinary electrolysis, failing to produce uniform electrolytic copper foil sufficiently free from pinholes and curl.

Hereinafter the present invention will be described in more detail referring to working examples, which however do not limit the scope of the present invention.

EXAMPLE 1 AND COMPARATIVE EXAMPLE 1

Example 1

Electrolytic copper foil was produced by using an apparatus as shown in FIG. 2. That is, the apparatus used is for producing copper foil by applying electric current between titanium cathode drum 2 of 2 m diameter and 1.5 m width and anode 3, which had an arcuate section, was made of an iridium oxide-coated titanium base material and faced cathode drum 2 leaving gap 4 (10 mm), while flowing electrolytic solution 5 into gap 4 through electrolytic solution inlet 3*a* provided at the bottom of anode 3. Horizontal electrolytic solution receiver 11 made of an insulating material was placed 20 mm above the upper end of anode 3 over which electrolytic solution 5 flows on the side where electrodeposition begins, and as shown in FIG. 3, 36 mm high auxiliary anode 7, which was made of an iridium oxide-coated titanium base material and had slit 8, was vertically mounted on the middle of electrolytic solution receiver 11. Behind auxiliary anode 7 was mounted electrolytic solution feeding pipe 10 made of titanium with slit 9 aligned with slit 8. Slit 9 of electrolytic solution feeding pipe 10 was 3 mm wide, and the width of slit 8 of auxiliary anode 7 was adjusted to 0.4 mm wide at the middle and 0.6 mm wide at both ends to keep the surface of electrolytic solution holdup 12 flat. There was gap 14 of 1 mm between the edge of electrolytic solution receiver 11 and cathodic drum surface 2*a*. 15 mm high flashboards 13 made of an insulating material was attached to both sides of electrolytic solution receiver 11 as shown in FIG. 4, and the feeding rate of electrolytic solution from electrolytic solution feeding pipe 10 was controlled so that the depth of electrolytic solution holdup 12 was kept to 15 to 20 mm.

By using the apparatus as described above, 12 $\mu$m thick electrolytic copper foils were produced by using a copper sulfate solution made acidic with sulfuric acid as an electrolytic solution and applying electric current between cathode drum 2 and anode 3 and between cathode drum 2 and auxiliary anode 7 under the following conditions. The current density of arcuate anode 3 was kept uniform, and the current density of auxiliary anode 7 was varied.

Composition of electrolytic solution

Copper sulfate pentahydrate: 300 g/l

Sulfuric acid: 43 g/l

Gelatin: 5 mg/l

Electrolysis condition

Current density: arcuate anode 40 A/dm$^2$ (uniform)

Current density: auxiliary anode 80, 120, 160 and 200 A/dm$^2$ (varied)

Temperature of electrolytic solution: 48° C.

Feeding rate of electrolytic solution:

arcuate anode 120 l/min auxiliary anode 40 l/min

Rotating rate of cathode drum: 140 m/h

The electrolytic copper foils obtained were subjected to the following tests, and the results are listed in Table 1.

(1) Measurement of pinholes

① Copper foil of 1400 mm width and a length of one round of the cathodic drum was placed as a test piece on a flat surface, with S surface (the surface contacted the drum) upside.

② A penetrant, which was a dye penetrant flaw detector produced by Nippon Oil & Fats Co., Ltd., was applied all over the S surface with a roller.

③ After allowed stand for 30 minutes, the M surface (electrodeposition surface) of the copper foil were observed for the number of stained points (red) as pinholes through which the penetrant penetrated.

(2) Measurement of curl

① A 300 mm length test piece was cut out by a cutter from the 1400 mm wide copper foil, with the S surface of the copper foil looking upward.

② The specimen was placed on a flat surface with its M surface upside.

③ The vertical gap between the flat surface and the test piece at its ends in the longitudinal direction was measured with vernier calipers (n=10), to obtain an average value as the amount of curl (mm).

Comparative Example 1

Figure 1:
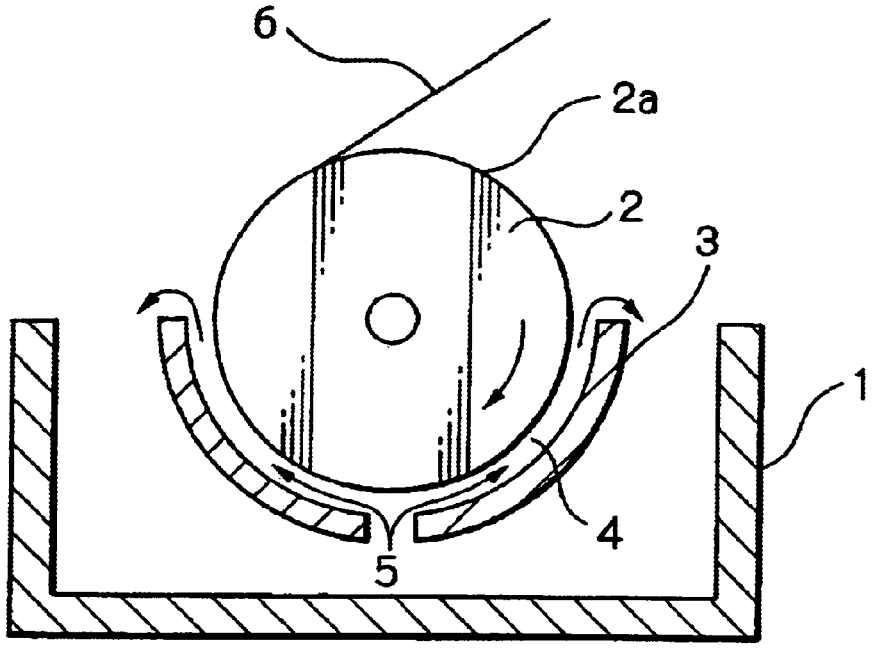
FIG. 1 is a sectional view illustrating a conventional apparatus for producing electrolytic copper foil.

By using the same apparatus and the same electrolytic solution as those described above, 12 $\mu$m thick electrolytic copper foil was produced in the same manner as in Example 1, except that only anode 3 was used as shown in FIG. 1 without feeding the electrolytic solution from electrolytic solution feeding pipe 10 as shown in FIG. 2 nor applying electric current from auxiliary anode 7. The characteristics of the electrolytic copper foil obtained were measured in the same manner as in Example 1, and the results are listed in Table 1.

TABLE 1

| | Current density of auxiliary anode (A/dm$^2$) | Pinholes (number) | Curl (mm) |
|---|---|---|---|
| Example 1 | 80 | 3 | 4.1 |
| | 120 | 2 | 3.1 |
| | 160 | 0 | 2.3 |
| | 200 | 0 | 2.0 |
| Comp. Example 1 | — | 14 | 10.2 |

As described above, when the method and apparatus of the present invention are used for the production of electrolytic copper foil, the initial formation of crystal nuclei of electrolytic copper foil can be performed by using an electrolytic solution free from a large amount of gas generated by electrolysis, thereby giving uniform electrolytic copper foil sufficiently freed from pinholes and curl.

What is claimed is:

1. A method of producing electrolytic copper foil, comprising applying a direct current between a rotating cathode drum having a cathodic drum surface and an anode, which has an arcuate section and faces the cathodic drum surface to define a gap between them, while an electrolytic solution is being fed to the gap to electrodeposit electrolytic copper foil on the cathodic drum surface; and applying a direct current between the rotating cathode drum and an auxiliary anode, which is mounted together with an electrolytic solution receiver and a flashboard above the anode having an arcuate section, while an electrolytic solution is being fed onto the cathodic drum surface from an electrolytic solution feeder provided near the auxiliary anode and is being discharged through a gap between the cathodic drum surface and an edge of the electrolytic solution receiver while keeping an electrolytic solution holdup between the cathodic drum surface and the auxiliary anode by the electrolytic solution receiver and the flashboard.

2. The method of claim 1, wherein the auxiliary anode is applied with a current density higher than a current density applied to the anode having an arcuate section.

3. The method of claim 2, wherein the current density of the auxiliary anode is 1.5 to 10 times that of said anode.

4. The method of claim 1, wherein said electrolytic solution receiver is positioned under said auxiliary anode.

5. The method of claim 1, wherein a gap between the auxiliary anode and cathodic drum surface is 5 to 20 mm.

6. The method of claim 1, wherein a depth of said electrolytic solution holdup is 5 to 25 mm.

7. The method of claim 1, wherein said gap between the cathodic drum surface and said edge of the electrolytic solution receiver is 1 to 5 mm.

8. The method of claim 1, wherein the electrolytic solution is fed from the electrolytic solution feeder at a feeding rate of at least 20 l/mm.

9. The method of claim 1, wherein a gap is provided between an upper end of said anode which has an arcuate section and an underside of the electrolytic solution receiver.

10. The method of claim 9, wherein said gap between said upper end of said anode which has an arcuate section and said underside of the electrolytic solution receiver is 15 to 30 mm.

11. The method of claim 1, wherein said auxiliary anode is positioned above the anode having the arcuate section, at a side of the rotating cathode drum where a point on the surface of the rotating cathode drum is initially introduced to the electrolytic solution.

12. An apparatus for producing an electrolytic copper foil by applying a direct current between a rotating rotary cathode drum having a cathodic drum surface and an anode, which has an arcuate section and faces the cathode drum to define a gap between them, while an electrolytic solution is being fed to the gap to electrodeposit electrolytic copper foil on the cathodic drum surface, comprising the rotary cathode drum having the cathodic drum surface;

the anode, which has an arcuate section and faces the cathodic drum surface to define a gap therebetween;

a means of feeding the electrolytic solution to the gap between the cathodic drum surface and the anode;

an auxiliary anode facing the cathodic drum surface above the anode having an arcuate section;

an electrolytic solution feeder for feeding an electrolytic solution between the cathodic drum surface and the auxiliary anode; and an electrolytic solution receiver and a flashboard which are placed above the anode having an arcuate section so as to keep an electrolytic solution holdup between the cathodic drum surface and the auxiliary anode;

a gap being left between the upper end of the anode having an arcuate section and an underside of the electrolytic solution receiver, and a gap being left between the cathodic drum surface and an edge of the electrolytic solution receiver.

13. The apparatus of claim 12, wherein the auxiliary anode is a flat-plate anode provided with a slit at the middle, and the electrolytic solution feeder is a hollow pipe provided with a slit aligned with the slit of the auxiliary anode.

14. The apparatus of claim 12, wherein the auxiliary anode is a flat-plate anode provided with a slit at the middle, and the electrolytic solution feeder is a hollow pipe, which is provided with pores aligned with the slit of the auxiliary anode.

15. The apparatus of claim 12, wherein said gap between said upper end of said anode which has an arcuate section and said underside of the electrolytic solution receiver is 15 to 30 mm.

16. The apparatus of claim 12, wherein said gap between the cathodic drum surface and said edge of the electrolytic solution receiver is 1 to 5 mm.

17. The apparatus of claim 12, wherein said auxiliary anode is positioned above the anode having the arcuate section, at a side of the rotary cathode drum where, when the rotary cathode drum is rotating, a point on the surface of the rotary cathode drum is initially introduced to the electrolytic solution.

* * * * *